US011835053B2

(12) United States Patent
Wang et al.

(10) Patent No.: US 11,835,053 B2
(45) Date of Patent: Dec. 5, 2023

(54) SYSTEM AND METHOD FOR PREDICTING A SURGE OF A CENTRIFUGAL REFRIGERATION COMPRESSOR AND AIR-CONDITIONING UNIT

(71) Applicant: Carrier Corporation, Palm Beach Gardens, FL (US)

(72) Inventors: Jialong Wang, Shanghai (CN); Qiang Chen, Shanghai (CN); Guicai Zhang, Shanghai (CN); Yun Li, Shanghai (CN); Haitao Zhou, Shanghai (CN); Zhen Jia, Shanghai (CN); Chao Wang, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 363 days.

(21) Appl. No.: 15/734,042

(22) PCT Filed: Aug. 8, 2019

(86) PCT No.: PCT/US2019/045735

§ 371 (c)(1),
(2) Date: Dec. 1, 2020

(87) PCT Pub. No.: WO2020/036805

PCT Pub. Date: Feb. 20, 2020

(65) Prior Publication Data

US 2021/0215161 A1 Jul. 15, 2021

(30) Foreign Application Priority Data

Aug. 13, 2018 (CN) ..... 201810916145.4

(51) Int. Cl.
*F04D 27/00* (2006.01)
*F04D 17/10* (2006.01)
(Continued)

(52) U.S. Cl.
CPC ..... *F04D 27/001* (2013.01); *F04D 17/10* (2013.01); *F04D 27/02* (2013.01); *F25B 1/053* (2013.01);
(Continued)

(58) Field of Classification Search
CPC ..... F04D 17/10; F04D 27/001; F04D 27/02; F25B 1/053; F25B 49/022; F25B 2700/151; F25B 2700/1931; F25B 2700/1933
See application file for complete search history.

(56) References Cited

U.S. PATENT DOCUMENTS 4,608,833 A 9/1986 Kountz
7,539,549 B1 5/2009 Discenzo et al.
(Continued)

FOREIGN PATENT DOCUMENTS

CN 101387306 A 3/2009
CN 101718269 A 6/2010
(Continued)

OTHER PUBLICATIONS

International Search Report for International Application No. PCT/US2019/045735, International Filing Date Aug. 8, 2019, dated Oct. 17, 2019, 6 pages.
(Continued)

*Primary Examiner* — Audrey B. Walter
(74) *Attorney, Agent, or Firm* — CANTOR COLBURN LLP

(57) ABSTRACT

A system for predicting a surge of a centrifugal refrigeration compressor including a signal capturing module for capturing at least two signals relevant to the centrifugal refrigeration compressor; a feature extracting module defining a window period for extracting data of the at least two signals, and defining at least two feature functions respectively
(Continued)

acting on the data in the window period of the at least two signals; and, a feature analyzing and deducing module calculating a feature value for each of the signals to map a probability value of surge prediction for each of the signals, and concluding, based on the probability value of the surge prediction of each of the signals, a final probability value to determine whether or not the surge will occur to the centrifugal refrigeration compressor.

17 Claims, 2 Drawing Sheets

(51) Int. Cl.
*F04D 27/02* (2006.01)
*F25B 1/053* (2006.01)
*F25B 49/02* (2006.01)

(52) U.S. Cl.
CPC ..... *F25B 49/022* (2013.01); *F25B 2500/19* (2013.01); *F25B 2700/151* (2013.01); *F25B 2700/1931* (2013.01); *F25B 2700/1933* (2013.01)

(56) References Cited

U.S. PATENT DOCUMENTS

| | | | | |
|---|---|---|---|---|
| 7,650,777 | B1 * | 1/2010 | Krok | F04D 27/001 73/112.05 |
| 8,185,291 | B2 | 5/2012 | Nakakita et al. | |
| 8,342,793 | B2 | 1/2013 | Way et al. | |
| 2010/0011846 | A1 | 1/2010 | Krok et al. | |
| 2012/0100011 | A1 | 4/2012 | Sommer et al. | |
| 2013/0186191 | A1 | 7/2013 | Djelassi | |
| 2015/0322814 | A1 | 11/2015 | Liu et al. | |
| 2016/0103012 | A1 | 4/2016 | Liu | |
| 2016/0123175 | A1 | 5/2016 | Mazzaro | |
| 2017/0370368 | A1 * | 12/2017 | Srivastava | F04D 27/001 |

FOREIGN PATENT DOCUMENTS

| | | | | |
|---|---|---|---|---|
| CN | 101713395 | B | 8/2011 | |
| CN | 101887479 | B | 5/2012 | |
| CN | 105298889 | A | 2/2016 | |
| CN | 106126795 | A | 11/2016 | |
| JP | H02286899 | A | 11/1990 | |
| WO | 9744719 | A1 | 11/1997 | |
| WO | WO-2013110324 | A1 * | 8/2013 | F04D 27/001 |
| WO | 2014191051 | A1 | 12/2014 | |

OTHER PUBLICATIONS

Jan van Helvoirt. "Centrifugal Compressor Surge, Modeling and Identification for Control". Eindhoven : Technische Universiteit Eindhoven, 2007 Proefschrift.—ISBN-13: 978-90-386-1095-5. 219 pages.

Nicolas Courtiade. "Experimental analysis of the unsteady flow and instabilities in a high-speed multistage compressor". Other. Ecole Centrale de Lyon, 2012. English. <NNT : 2012ECDL0044>. <tel-00838695>. 196 pages.

Written Opinion for International Application No. PCT/US2019/045735, International Filing Date Aug. 8, 2019, dated Oct. 17, 2019, 7 pages.

European Examination Report for Application No. 19755782.0; dated Mar. 14, 2022; 5 Pages.

Chinese Office Action for Application No. 201810916145.4; dated Sep. 5, 2022; 8 Pages.

* cited by examiner

SYSTEM AND METHOD FOR PREDICTING A SURGE OF A CENTRIFUGAL REFRIGERATION COMPRESSOR AND AIR-CONDITIONING UNIT

CROSS REFERENCE TO RELATED APPLICATIONS

This is a U.S. National Stage of Application No. PCT/US2019/045735, filed Aug. 8, 2019, which claims priority to Chinese Application No. 201810916145.4, filed Aug. 13, 2018, the disclosures of which are incorporated herein by reference in their entireties.

TECHNICAL FIELD

The present invention relates to a system for predicting a surge of a centrifugal refrigeration compressor, an air-conditioning unit and a method for predicting the surge of the centrifugal refrigeration compressor.

BACKGROUND ART

The centrifugal refrigeration compressor, as a speed-type compressor, would have in its operation the phenomenon of surges. In terms of a central refrigeration air-conditioning unit with a centrifugal compressor employed, one shall prevent the occurrence of surge phenomena at any time in its design and practical use.

Reasons of the occurrence of surge phenomena in the operation of a compressor can be roughly classified into two types: a. high pressure difference; b. low flow rate. The air flow regulation by inlet guide vane (IGV) and the motor speed regulation by variable-frequency driver (VFD) of a compressor unit in a compressor operation, due to these two factors, would both need to be properly restricted so as to prevent the occurrence of surge phenomena, which, to some extent, restrict the actual operation range of the compressor unit. Meanwhile, the occurrence of surge phenomena will be induced in the compressor unit if the temperature of cooling water in the centrifugal refrigeration compressor is a bit high due to the insufficient capability of a cooling tower such that the condensing pressure goes beyond the design pressure of the unit, or with the conditions such as a bit low temperature of chilling water caused by practical loads being lower than the lower regulation limit of the unit capacity. In the prior art, multiple methods have been developed to detect surges of centrifugal refrigeration compressors; however, these methods will all act after the occurrence of a surge, none of which can fulfill the function of prevention in advance.

Thus, it is urgent to find a system for predicting a surge of a centrifugal refrigeration compressor which can address the technical problem by means of innovation.

SUMMARY

In view of this, according to the first aspect of the present invention, it provides a system for predicting a surge of a centrifugal refrigeration compressor so as to effectively address aforesaid technical problem and problems in other aspects existing in prior arts. The system for predicting the surge of the centrifugal refrigeration compressor according to the present invention comprises:

a signal capturing module for capturing at least two signals relevant to the centrifugal refrigeration compressor;

a feature extracting module defining a window period for extracting data of the at least two signals, and defining at least two feature functions respectively acting on the data in the window period of the at least two signals; and, a feature analyzing and deducing module calculating a feature value for each of the signals to map a probability value of surge prediction for each of the signals, and concluding, based on the probability value of surge prediction for each of the signals, a final probability value to determine whether or not the surge will occur to the centrifugal refrigeration compressor.

In one favorable embodiment of the system for predicting the surge of the centrifugal refrigeration compressor according to the present invention, the system further comprises a controlling and regulating module for regulating the centrifugal refrigeration compressor.

In another favorable embodiment of the system for predicting the surge of the centrifugal refrigeration compressor according to the present invention, the controlling and regulating module comprises a suppressing mode and a default control mode for controlling inlet guide vanes and/or a variable-frequency driver of the centrifugal refrigeration compressor.

In another favorable embodiment of the system for predicting the surge of the centrifugal refrigeration compressor according to the present invention, the feature analyzing and deducing module is configured to calculate a number of feature values for each of the signals to map a probability value of surge prediction for each of the signals.

In another favorable embodiment of the system for predicting the surge of the centrifugal refrigeration compressor according to the present invention, the final probability value is obtained according to the probability values of surge prediction for each of the signals by means of weight averaging, arithmetic averaging or taking a maximum value.

In another favorable embodiment of the system for predicting the surge of the centrifugal refrigeration compressor according to the present invention, the signal is a signal of electric current percentage, condensing pressure or evaporating pressure of the centrifugal refrigeration compressor.

In another favorable embodiment of the system for predicting the surge of the centrifugal refrigeration compressor according to the present invention, the window period ranges between 10-60 seconds.

Moreover, according to the second aspect of the present invention, it further provides an air-conditioning unit comprising aforesaid system for predicting a surge of a centrifugal refrigeration compressor.

Further, according to the third aspect of the present invention, it also provides a method for predicting a surge of a centrifugal refrigeration compressor. The method for predicting the surge of the centrifugal refrigeration compressor comprises:

Step 1: capturing at least two signals relevant to the centrifugal refrigeration compressor;

Step 2: defining a window period for extracting data of the at least two signals and defining at least two feature functions respectively acting on the data in the window period of the at least two signals; and, Step 3: calculating a feature value for each of the signals to map a probability value of surge prediction for each of the signals, and concluding a final probability value based on the probability value of surge prediction for each of the signals.

According to another favorable embodiment of the method for predicting the surge of the centrifugal refrigeration compressor according to the present invention, in Step 3, when the probability values of surge prediction for all of the signals are larger than a preset threshold, and the final probability value is larger than a preset threshold, a conclusion that the surge will occur will be obtained; otherwise, a conclusion that the surge will not occur will be obtained.

According to another favorable embodiment of the method for predicting the surge of the centrifugal refrigeration compressor according to the present invention, in Step 3, when the probability value of surge prediction for at least one of the signals is larger than a preset threshold, a conclusion that the surge will occur will be obtained; otherwise, a conclusion that the surge will not occur will be obtained.

According to another favorable embodiment of the method for predicting the surge of the centrifugal refrigeration compressor according to the present invention, in a Step 4, if the conclusion that the surge will occur is obtained, a suppressing mode will be started to increase the output frequency of a variable-frequency driver of the centrifugal refrigeration compressor and/or decrease the open degree of inlet guide vanes of the centrifugal refrigeration compressor; and, if the conclusion that the surge will not occur is obtained, a default control mode will be employed for the variable-frequency driver and/or the inlet guide vanes of the centrifugal refrigeration compressor.

It is known that the system for predicting the surge of the centrifugal refrigeration compressor and the method for predicting the surge of the centrifugal refrigeration compressor of the present invention can precisely predict and prevent surges of the centrifugal refrigeration compressor so as to prolong its life further.

DESCRIPTION OF FIGURES

Figures and embodiments will be combined below to further describe the technical solution of the present invention in details.

EMBODIMENTS

The technical solutions of embodiments of the present invention will be clearly and completely described below in combination with the figures thereof. Apparently, the described embodiments are only partial ones, rather than all embodiments. Based on the embodiments of the present invention, all other embodiments that one skilled in the art obtain without creative work will fall into the protection scope of the present invention.

Figure 1:
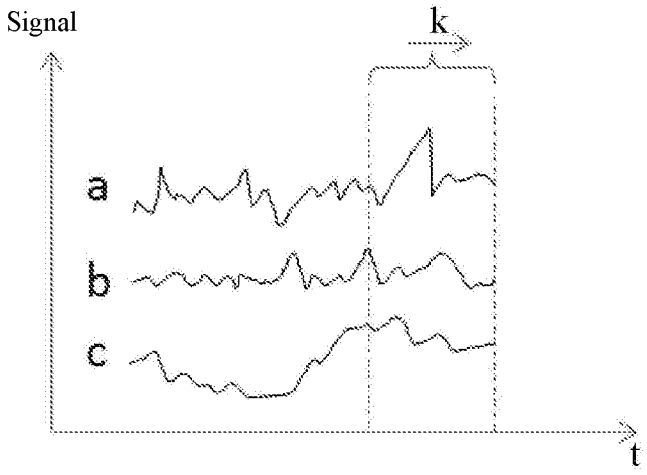
FIG. 1 is a time-signal diagram concerning signal collection and feature extraction in one embodiment of the system for predicting a surge of a centrifugal refrigeration compressor according to the present invention.

The present invention proposes an embodiment for the system for predicting a surge of a centrifugal refrigeration compressor. To be specific, the system for predicting the surge of the centrifugal refrigeration compressor consists of a signal capturing module, a feature extracting module and a feature analyzing and deducing module. In the embodiment illustrated by FIG. 1, the signal capturing module is configured to capture three signals a, b and c relevant to the centrifugal refrigeration compressor, e.g., signals can be directly measured such as electric current percentage, condensing pressure or evaporating pressure of the centrifugal refrigeration compressor. The feature extracting module defines a window period k, e.g., within a range between 10-60 seconds, for extracting data of the three signals a, b and c, and defines feature functions F1, F2 and F3 respectively acting on the data in the window period of the signals. The feature analyzing and deducing module is configured to calculate a feature value, preferably a number of feature values (such as the amplitudes, variance yields and average values of signals), for each of the signals to map a probability value Pa, Pb or Pc (within the range of 0-1) of surge prediction for each of the signals, and concludes a final probability value Pabc to determine whether or not the surge will occur to the centrifugal refrigeration compressor based on the probability value Pa, Pb or Pc of surge prediction for each of the signals by means of weight averaging, arithmetic averaging, taking the maximum value or the like.

In other preferable embodiments in combination with aforesaid embodiment, the system for predicting the surge of the centrifugal refrigeration compressor according to the present invention further comprises a controlling and regulating module for regulating the centrifugal refrigeration compressor. Further, based on whether the centrifugal refrigeration compressor has a variable-frequency driver, the controlling and regulating module comprises a suppressing mode and a default control mode for controlling inlet guide vanes and/or the variable-frequency driver of the centrifugal refrigeration compressor.

As shall be explained, to ensure the accuracy of the system for predicting the surge of the centrifugal refrigeration compressor of the present invention, the number of signals relevant to the centrifugal refrigeration compressor shall be at least two and, thus, the number of the feature functions matching with the signals shall also be at least two. Certainly, one skilled in the art can understand that the signals relevant to the centrifugal refrigeration compressor can also include other ordinary signals in a refrigeration circulation, and the number may be four, five, six, seven or more. Obviously, more signals are measured, higher accuracy of surge prediction the whole system would have.

Moreover, the present invention also provides an air-conditioning unit comprising aforesaid system for predicting the surge of the centrifugal refrigeration compressor.

Figure 2:
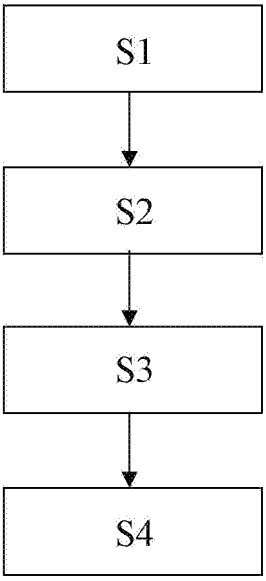
FIG. 2 is a flow chart illustrating the method for predicting the surge of the centrifugal refrigeration compressor according to the present invention.

Further, the present invention provides a method for predicting the surge of the centrifugal refrigeration compressor, comprising (as shown in FIG. 2):

- Step 1 (S1): capturing at least two signals relevant to the centrifugal refrigeration compressor;
- Step 2 (S2): defining a window period for extracting data of the at least two signals, and defining at least two feature functions respectively acting on the data in the window period of the at least two signals; and,
- Step 3 (S3): calculating a feature value for each of the signals to map a probability value of surge prediction for each of the signals, and concluding a final probability value based on the probability value of the surge prediction for each of the signals.

According to aforesaid method, preferably in Step 3 (S3), when the probability values of surge prediction for all of the signals are larger than a preset threshold, and the final probability value is larger than a preset threshold, a conclusion that the surge will occur will be obtained; otherwise, a conclusion that the surge will not occur will be obtained.

According to aforesaid method, preferably in Step 3 (S3), when the probability value of surge prediction for at least one of the signals is larger than a preset threshold, a conclusion that the surge will occur will be obtained; otherwise, a conclusion that the surge will not occur will be obtained.

Furthermore, in Step 4 (S4), if the conclusion that the surge will occur is obtained, under the condition that the centrifugal refrigeration compressor has variable-frequency driving, a suppressing mode will be started to increase the output frequency of a variable-frequency driver of the centrifugal refrigeration compressor and decrease the open degree of inlet guide vanes of the centrifugal refrigeration compressor; if the conclusion that the surge will not occur is obtained, a default control mode will be employed for the variable-frequency driver and the inlet guide vanes of the centrifugal refrigeration compressor.

In addition, in Step 4 (S4), if the conclusion that the surge will occur is obtained, under the condition that the centrifugal refrigeration compressor does not have variable-frequency driving, the suppressing mode will be started to decrease the open degree of the inlet guide vanes of the centrifugal refrigeration compressor; if the conclusion that the surge will not occur is obtained, the default control mode will be employed for the inlet guide vanes of the centrifugal refrigeration compressor.

In sum, the system for predicting the surge of the centrifugal refrigeration compressor and its method provided by the present invention can obtain a comprehensive deduction index based on conjoint analysis and deduction, such that surges of the centrifugal refrigeration compressor can be effectively predicted and a timely adjustment can be made to the centrifugal refrigeration compressor to prevent mechanical damages caused by surges.

In the preceding text, several concrete implementation means are cited to specifically expound the system and method for predicting the surge of the centrifugal refrigeration compressor and the air-conditioning unit. These individual examples are purely for explaining the principle and implementation means of the present invention, rather than for limiting the present invention. Without a deviation from the spirit and scope of the present invention, one skilled in the art may further make any transformations and modifications. Therefore, all equivalent to technical solutions shall belong to the scope of the present invention and be limited by all claims of the present invention.

What is claimed:

1. A system for predicting a surge of a centrifugal refrigeration compressor, comprising:

a signal capturing module configured to capture at least two signals relevant to the centrifugal refrigeration compressor;

a feature extracting module configured to define a window period for extracting data of the at least two signals, and configured to define at least two feature functions respectively acting on the data in the window period of the at least two signals; and, a feature analyzing and deducing module configured to calculate a feature value for each of the signals to map a probability value of surge prediction for each of the signals, and configured to conclude, based on the probability value of surge prediction for each of the signals, a final probability value to determine whether or not the surge will occur to the centrifugal refrigeration compressor;

wherein the system further comprises a controlling and regulating module configured to regulate the centrifugal refrigeration compressor.

2. The system of claim 1, wherein the controlling and regulating module comprises a suppressing mode and a default control mode for controlling at least one of inlet guide vanes and a variable-frequency driver of the centrifugal refrigeration compressor.

3. The system of claim 1, wherein the feature analyzing and deducing module is configured to calculate a number of feature values for each of the signals to map a probability value of surge prediction for each of the signals.

4. The system of claim 1, wherein the final probability value is obtained according to the probability values of surge prediction for each of the signals by means of at least one of weight average, arithmetic average, or taking a maximum value.

5. The system of claim 1, wherein each signal is a signal of at least one of electric current percentage, condensing pressure, or evaporating pressure of the centrifugal refrigeration compressor.

6. The system of claim 1, wherein the window period ranges between 10-60 seconds.

7. An air-conditioning unit, comprising a system for predicting a surge of a centrifugal refrigeration compressor of the air-conditioning unit, the system comprising:

a signal capturing module configured to capture at least two signals relevant to the centrifugal refrigeration compressor;

a feature extracting module configured to define a window period for extracting data of the at least two signals, and configured to define at least two feature functions respectively acting on the data in the window period of the at least two signals; and, a feature analyzing and deducing module configured to calculate a feature value for each of the signals to map a probability value of surge prediction for each of the signals, and configured to conclude, based on the probability value of surge prediction for each of the signals, a final probability value to determine whether or not the surge will occur to the centrifugal refrigeration compressor;

wherein the system further comprises a controlling and regulating module configured to regulate the centrifugal refrigeration compressor.

8. The air-conditioning unit of claim 7, wherein the controlling and regulating module comprises a suppressing mode and a default control mode for controlling at least one of inlet guide vanes and a variable-frequency driver of the centrifugal refrigeration compressor.

9. The air-conditioning unit of claim 7, wherein the feature analyzing and deducing module is configured to calculate a number of feature values for each of the signals to map a probability value of surge prediction for each of the signals.

10. The air-conditioning unit of claim 7, wherein the final probability value is obtained according to the probability values of surge prediction for each of the signals by means of at least one of weight average, arithmetic average, or taking a maximum value.

11. The air-conditioning unit of claim 7, wherein each signal is a signal of at least one of electric current percentage, condensing pressure, or evaporating pressure of the centrifugal refrigeration compressor.

12. The air-conditioning unit of claim 7, wherein the window period ranges between 10-60 seconds.

13. A method for predicting a surge of a centrifugal refrigeration compressor, comprising:

Step 1: capturing at least two signals relevant to the centrifugal refrigeration compressor;

Step 2: defining a window period for extracting data of the at least two signals and defining at least two feature functions respectively acting on the data in the window period of the at least two signals; and Step 3: calculating a feature value for each of the signals to map a probability value of surge prediction for each of the signals, and concluding a final probability value based on the probability value of surge prediction for each of the signals;

wherein the method further comprises controlling and regulating the centrifugal refrigeration compressor.

14. The method of claim 13, wherein in Step 3, when the probability values of surge prediction for all of the signals are larger than a preset threshold, and the final probability value is larger than a preset threshold, a conclusion that the surge will occur will be obtained; otherwise, a conclusion that the surge will not occur will be obtained.

15. The method of claim 14, further comprising:

Step 4: if the conclusion that the surge will occur is obtained, a suppressing mode will be started to increase the output frequency of a variable-frequency driver of the centrifugal refrigeration compressor and/or decrease the open degree of inlet guide vanes of the centrifugal refrigeration compressor; and, if the conclusion that the surge will not occur is obtained, a default control mode will be employed for the variable-frequency driver and/or the inlet guide vanes of the centrifugal refrigeration compressor.

16. The method of claim 13, wherein in Step 3, when the probability value of surge prediction for at least one of the signals is larger than a preset threshold, a conclusion that the surge will occur will be obtained; otherwise, a conclusion that the surge will not occur will be obtained.

17. The method of claim 16, further comprising:

Step 4: if the conclusion that the surge will occur is obtained, a suppressing mode will be started to increase the output frequency of a variable-frequency driver of the centrifugal refrigeration compressor and/or decrease the open degree of inlet guide vanes of the centrifugal refrigeration compressor; and, if the conclusion that the surge will not occur is obtained, a default control mode will be employed for the variable-frequency driver and/or the inlet guide vanes of the centrifugal refrigeration compressor.

* * * * *